United States Patent [19]

Manolis

[11] Patent Number: 4,762,101

[45] Date of Patent: Aug. 9, 1988

[54] GLOW PLUG

[76] Inventor: John Manolis, P.O. Box 380, New York, N.Y. 10028

[21] Appl. No.: 128,906

[22] Filed: Dec. 4, 1987

[51] Int. Cl.[4] ..... F02P 19/02

[52] U.S. Cl. ..... 123/145 A; 219/270

[58] Field of Search ..... 123/145 A, 145 R; 219/260, 270, 505, 543

[56] References Cited

U.S. PATENT DOCUMENTS

| | | | |
|---|---|---|---|
| 2,127,983 | 8/1938 | Nowosiolski | 123/145 A |
| 3,458,766 | 7/1969 | Little | 219/270 |
| 3,911,326 | 10/1975 | Ohlsson | 123/145 A |
| 4,058,105 | 5/1978 | Bhat et al. | 123/145 A |
| 4,412,126 | 10/1983 | Brocknall | 219/270 |
| 4,620,512 | 11/1986 | Brooks et al. | 123/145 A |
| 4,650,963 | 3/1987 | Yokoi | 123/145 A |
| 4,725,711 | 2/1988 | Minegishi et al. | 123/145 A |

*Primary Examiner*—Raymond A. Nelli

[57] ABSTRACT

A super heating glow plug according to the present invention includes a base portion having a fixing portion formed on an outer wall thereof and a terminal insulatedly provided therein and connected to an electrical source; a plurality of outwardly projected heating fins formed on the outer wall of the heating surface; a heating means, integrally connected to the base portion, having a heating surface formed on a wall surface thereof and composed of a catalyst comprising a transition material and a heating means having a resistive exothermic element connected to the element being provided adjacent.

5 Claims, 1 Drawing Sheet

GLOW PLUG

BACKGROUND OF THE INVENTION

The present invention relates to a glow plug used to preheat a subcombustion or combustion chamber of a diesel engine, and more particularly, to an improvement in a better heating type glow plug with a rod heater having a plurality of projected heating fins mounted on the outer wall of the heating rod, designed to increase heating surface and dissipate heat to the air-fuel for achieving a fast heating function and improving heating characteristics.

Since a diesel engine generally has poor starting characteristics at low temperatures, a glow plug is mounted in a subcombustion or combustion chamber thereof. A current is supplied to the glow plug to heat it. The heat from the glow plug increases an intake temperature, or is used as an ignition source, so that the starting characteristics of the diesel engine are improved. A typical conventional glow plug is of a sheath type wherein a metal sheath is filled with a refractory insulating powder, and a coil heater of iron chromium, nickel or the like is embedded in the powder. Another typical conventional glow plug is of a ceramic heater type. The ceramic heater type glow plug has a rod heater prepared by embedding a heater wire of tungsten or the like in a ceramic material. Both types of the conventional glow plugs possess drawbacks and disadvantages the heating surface of the rod heater of the glow plug is not sufficient to preheat and ignite air-fuel mixture in the combustion chamber.

Turning to the starting characteristics of diesel engines, the greater a heating surface of a heating rod of a glow plug, the more easily or positively the engine can be started at low ambient temperature, particularly when the glow plug is comprising with heating fins dissipating heat into the combustion chamber. Namely, when the heating surface of the heating rod of the glow plug is small, it takes a long period of time from the initial explosion to the complete explosion. The heating fins are dissipating equally heat towards all directions in the combustion chamber, to accomplish a fast and smooth start of the engine.

SUMMARY OF THE INVENTION

It is an object of the present invention to provide a glow plug having a heating rod comprising a plurality of projected heating fins mounted on the outer wall of the heating rod.

Another object of the present invention is to provide a glow plug having a heating rod comprising heating fins for accelerating the heating and ignition of the air-fuel in the combustion chamber of a diesel engine.

It is a further object of the invention to provide a glow plug for accelerating the ignition of fuel in a combustion chamber of a diesel engine and to minimize the period of time an operator of the engine must wait before the glow plug has been sufficiently heated.

DESCRIPTION OF THE PREFERRED EMBODIMENTS

The present invention will be described in detail with reference to the preferred embodiments in conjunction with the accompanying drawings.

Figure 1:
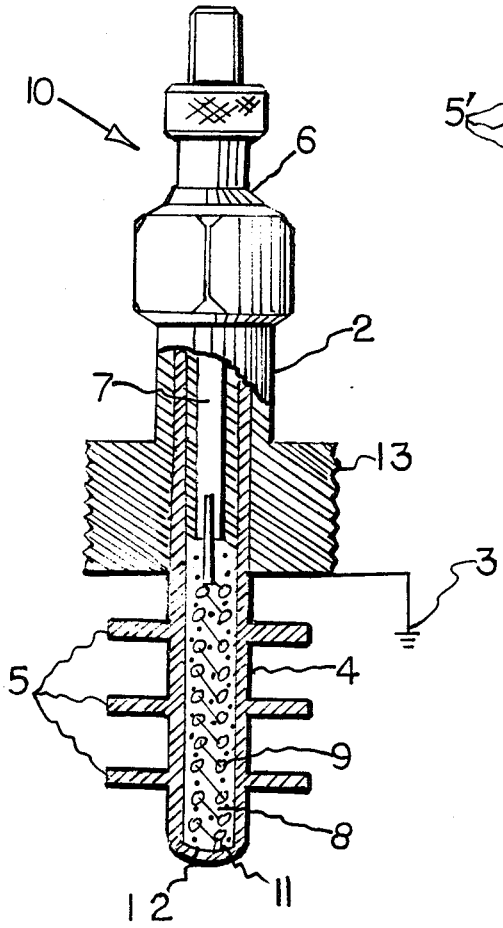
FIG. 1 is a partially longitudinal sectional view of a glow plug in accordance with the present invention.

Referring now in more detail to the Drawing FIG. 1 a glow plug indicated generally at 10 comprises a shell 2 threadbly engagable with the head of a combustion chamber of a diesel engine (not shown). The shell 2 is electrically grounded through the head of the combustion chamber as schematically indicated at 3. The glow plug also comprises an electrically conducting, tabular 4. The tubular heater 4 comprises a plurality of outwardly extending heating fins 5. The heating 5 are thin metalic or ceramic projections usually relatively rigid, flat or curved surfaces radially mounted along the tubular heating rod 4, of the glow plug 10. The heating fins 5 are designed to radiate and dissipate heat from the heating rod 4 to the air-fuel mixture in the combustion chamber of a diesel engine.

Figure 2:
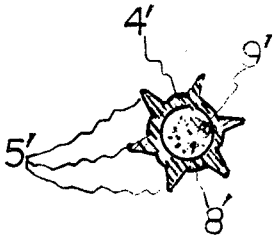
FIG. 2 is a sectional view of the glow plug showing the arrangement of the heating fins.

FIG. 2 shows the arrangement of the heating fins 5'. The glow plug 10 comprises an insulator 6 while holding a positive terminal 7. In the catalyst 8, there is coaxially arranged a resistive exothermic element 9 having a coil shape, which is connected highly conductively with the positive terminal 7. The resistive exothermic element 9 and the metal tube 4 are properly insulated from each other by the insulating function of the catalyst 8. The opposite end portion 11 of the resistive exothermal 7 of the same is grounded to the tubular heat rod 4 at the bottom portion 12 thereof. Thus, the glow plug 10 has its tubular heating rod 4, catalyst 8 and heating fins 5 constituting a superheating glow plug 10, a character 13 shows a screw part of an attachment shell 2 in the base portion for attaching the glow plug 10 to a predetermined portion of a combustion chamber in a diesel engine.

In operation: When it is intended to start the internal combustion engine with the chamber equipped with the superheating plug 10 the resistive exothermic element 9 of the glow plug 10 may be energized. As a result, the resistive exothermic element 9 liberates heat to heat the catalyst layer 8, the heating rod 4 and the heating fins 5.

The metal tube or heating rod 4 and the metal fins 5 create and dissipate enough heat to heat and ignite the air-fuel mixture in the combustion chamber of a diesel engine.

Moreover, the present invention can adopt modes of various modifications and deformations in addition to any suitable selected combination of the aforementioned respective embodiments if it is within the scope of the claim.

What is claimed is:

1. A super heating type glow plug comprising:

(i) a base portion having a fixing portion formed on an outer wall thereof and a terminal insulatedly provided therein and connected to an electrical source;

(ii) a plurality of heating means fins outwardly extending projections radially mounted on the outer wall of the base portion of the super heating glow plug;

(iii) a heater means integrally connected to the said base portion, having heating surface and heating fins formed on a wall surface thereof and composed of a catalyst a transition metal, and (iv) a heating means comprising a resistive exothermic element connected to the terminal of said base portion, the resistive exothermic element being provided adjacent to the heating surface within the heating means, whereby fuel may be heated, ignited and burned as a whole by said heading fins.

2. A super heating glow plug according to claim 1, wherein said super heating glow plug comprising a plurality of heating fins outwardly extending projections radially mounted on the outer wall of the base portion or heating rod member.

3. A super heating glow plug according to claim 1, wherein said heating fins are steel.

4. A super heating glow plug according to claim 1, wherein said heating fins are aluminum.

5. A super heating glow plug according to claim 1, wherein said heating fins are ceramic.

* * * * *